United States Patent [19]

Fehrer

[11] Patent Number: 4,524,580

[45] Date of Patent: Jun. 25, 1985

[54] APPARATUS FOR MAKING A YARN FROM A ROVING

[76] Inventor: Ernst Fehrer, Auf der Gugl 28, A-4020 Linz, Austria

[21] Appl. No.: 490,032

[22] Filed: Apr. 29, 1983

[30] Foreign Application Priority Data

Dec. 10, 1982 [AT] Austria ..... 4493/82

[51] Int. Cl.[3] ..... D01H 1/135; D01H 7/882

[52] U.S. Cl. ..... 57/401; 57/5; 57/328

[58] Field of Search ..... 57/401, 5, 224, 408, 57/411–413, 328

[56] References Cited

U.S. PATENT DOCUMENTS 4,112,658 9/1978 Morihashi ..... 57/328

4,183,202 1/1980 Morihashi ..... 57/328

4,322,944 4/1982 Sraitr et al. ..... 57/328

4,387,487 6/1983 Nakahaka et al. ..... 57/328 X

FOREIGN PATENT DOCUMENTS 367104 10/1981 Austria .

*Primary Examiner*—John Petrakes

*Attorney, Agent, or Firm*—Kurt Kelman

[57] ABSTRACT

Apparatus for making a high-strength yarn from a drawn roving comprises a twisting device for twisting the roving is as well as a separate winding device, which serves to wind protruding fiber ends around the roving and comprises a guide gap which is tapered transversely to the direction of travel of the roving in said gap and is bounded by sliding surfaces in contact with the roving.

9 Claims, 5 Drawing Figures

APPARATUS FOR MAKING A YARN FROM A ROVING

Figure 1:
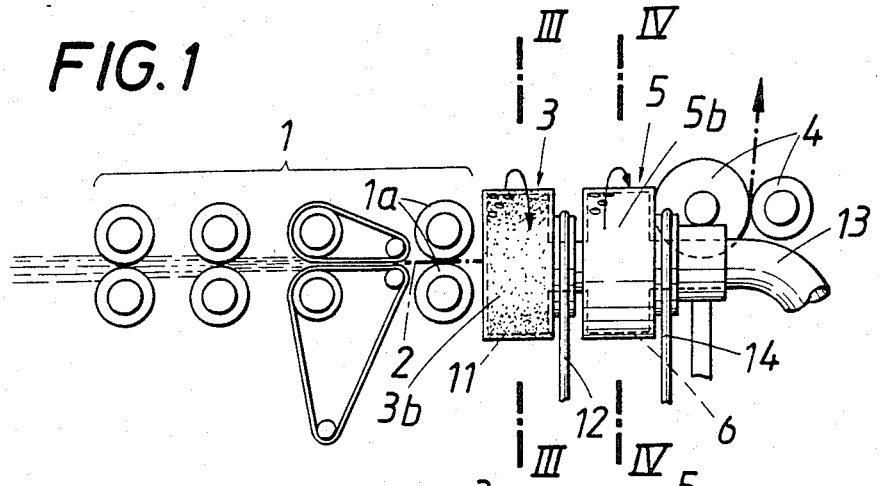

It is known from U.S. Pat. No. 4,420,928 that a yarn can be made by pulling a drawn roving through the generally triangular space between two suction drums which rotate in the same sense and are provided with two opposite rings for roughening the roving. The said suction drums twist the drawn roving and the fiber ends protruding from the roving as a result of the action of the roughening rings are wound around the roving. As the winding of the fiber ends around the roving depends on the slip between the roving and the suction drums, which twist the roving and have a higher circumferential velocity than the roving, the extent to which the fiber ends can be wound around the roving and the strength of the resulting yarn is restricted, particularly because the proportion of the fiber ends wound around the roving should be comparatively small.

It is an object of the invention so to improve such a yarn-making apparatus that yarns which have a desired strength and comprise only a low proportion of fiber ends wound around the roving can be made with a low structural expenditure.

This object is accomplished according to the invention by providing a twisting device for twisting the roving and a separate winding device which serves to wind protruding fiber ends around the roving and comprises a guide gap tapered transversely to the direction of travel of the roving in said gap and bounded by sliding surfaces in contact with the roving.

Because the twisting of the roving and the winding of the fiber ends protruding from the twisted roving around the latter are effected by separate devices, the conditions under which the roving is twisted can be selected without regard to the subsequent winding operation so that optimum conditions can be adopted. Besides, the special design of the device for winding the protruding fiber ends around the roving ensures that the protruding fiber ends will be wound around the roving in a sense which is opposite to the sense in which the roving is twisted. This is due to the fact that, as the rotating roving is moved past the sliding surfaces, the protruding fiber ends are deflected transversely to the axis of the roving and forced against the roving by said sliding surfaces. The fact that the protruding fiber ends are wound around the roving in a sense which is opposite to the sense in which the roving is twisted affords the essential advantage that the tendency of the twisted roving to untwist in a false-twisting sense necessarily causes a torque in the winding sense to be exerted in the fiber ends which have been wound around the roving and the coherence which is due to the fiber ends wound around the roving cannot be reduced by an untwisting roving. When the protruding fiber ends have been wound around the roving, the latter will be torsionally balanced independently of the degree to which it has been twisted.

To ensure that the protruding fiber ends can be tightly wound around the roving, said fiber ends must be properly forced against the roving. For this purpose, the roving must be in snug contact with the sliding surfaces. This requirement is met by sliding surfaces defining between them a guiding gap which tapers transversely to the direction of travel of the roving and ensures that the roving will be in snug contact with both sliding surfaces regardless of the diameter of the roving if the roving is pulled or pressed into said tapered guiding gap. It will be understood that the smallest width of the guiding gap must be smaller than the diameter of the roving. As a result, the protruding fiber ends are deflected mainly by the sliding surface at which the roving rotates opposite to the direction in which the gap is tapered whereas the other sliding surface substantially promotes the forcing of the fiber ends against the roving and the smoothening of the yarn.

To ensure that the roving will be pulled into the tapered guiding gap, at least one of the two sliding surfaces may be permeable to a vacuum for sucking the roving in the direction in which the guiding gap is tapered. If a vacuum is applied to both sliding surfaces, there will be a resulting suction force directed to the narrowest region of the guiding gap.

As has been stated hereinbefore, the protruding fiber ends cannot be effectively wound around the roving in a sense which is opposite to the sense in which the roving is twisted unless the roving performs an adequate rotation relative to the sliding surfaces. For this reason the rotation imparted to the roving by the twisting means must not be disturbingly resisted by the sliding surfaces. By the provision of smooth sliding surfaces the frictional resistance between the roving and the sliding surfaces can be reduced to such a small degree that an adequate rotation of the roving by the preceding twisting means will be ensured.

To ensure that the protruding fiber ends are deflected by the sliding surfaces transversely to the axis of the roving, said fiber ends must be moved to the sliding surfaces transversely to the latter. For this reason the guiding gap which is open on one side of the roving has the additional function of avoiding an axial deflection of a substantial part of the fiber ends. Optimum conditions regarding the deflection of the fiber ends by the sliding surfaces and the subsequent forcing of the deflected fiber ends against the roving can be obtained if the included angle of the guding gap decreases in the direction of travel of the roving.

In order to assist the winding of the protruding fiber ends around the roving in a sense which is opposite to the sense in which the roving is twisted, at least one of the sliding surfaces may be moved opposite to the direction in which the roving is rotated adjacent thereto. It will readily be understood that the winding of the protruding fiber ends around the roving can be promoted by such a movement of said sliding surface. Such a movement of the sliding surface will hardly resist the rotation of the roving because there is sliding friction at higher relative velocities.

The movement of the sliding surfaces can be ensured in a desirable manner if the guiding gap is defined by two juxtaposed revolvable members which are closely spaced apart and revolve in a sense which is opposite to the sense of rotation of the twisting device. Whereas said twisting members may consist, e.g., of endless belts, which are trained around reversing pulleys, a simpler structure will be obtained if said revolvable members consist of suction drums.

If the circumferential velocity of the withdrawing rollers is lower than the circumferential velocity of the pair of delivery rollers of a drawing frame for delivering the drawn roving, the roving will be in a substantially tensionless state as it is moved through the twisting device and the device for winding the protruding fiber ends around the roving. This will facilitate the twisting of the roving and will prevent a pulling apart of the convolutions of the fiber ends which have been wound around the roving and a decrease of their lead angle.

The rotation adjacent to the winding device can be promoted if the distance from the twisting device to the withdrawing rollers is substantially as large as the length of the guiding gap. As the rotation of the roving decreases from the twisting device to the withdrawing rollers, the distance between the twisting device and the guiding gap should be minimized.

Figure 2:
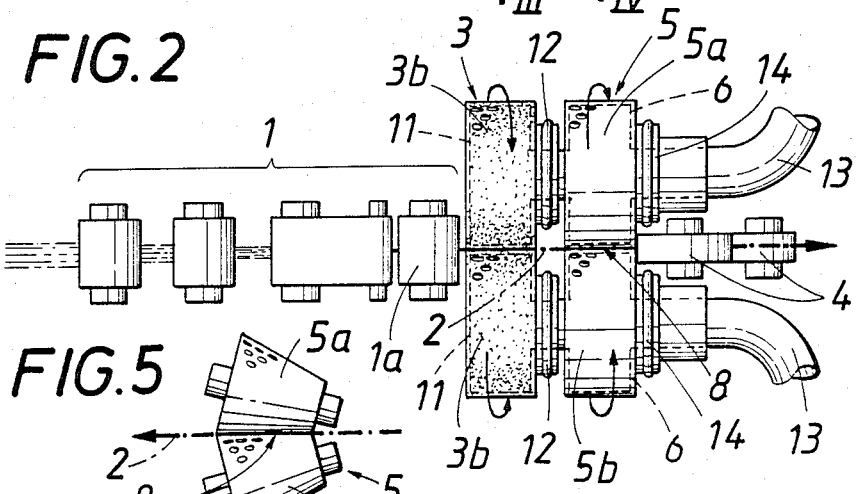
Figure 5:
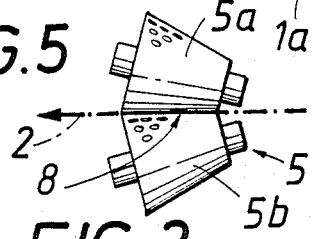
Figure 3:
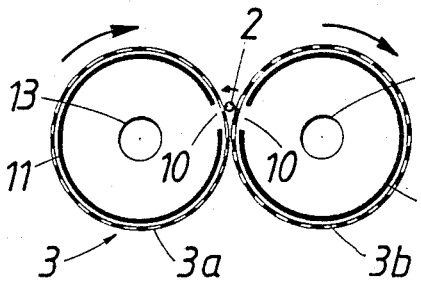
Figure 4:
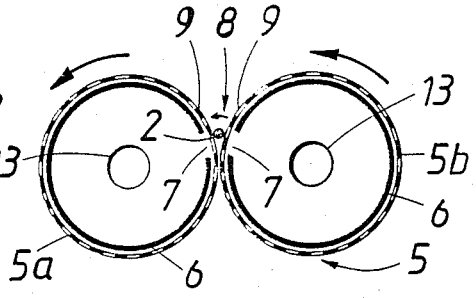

The subject matter of the invention is shown diagrammatically and by way of example in the drawings, in which FIG. 1 is a side elevation showing apparatus according to the invention for making a yarn from a roving, FIG. 2 is a top plan view showing that apparatus, FIG. 3 is a sectional view taken on line III—III in FIG. 1, FIG. 4 is a sectional view taken on line IV—IV in FIG. 1, and FIG. 5 is a diagrammatic top plan view showing another embodiment of means for winding the protruding fiber ends around the roving.

As is particularly apparent from FIGS. 1 and 2, the illustrated apparatus for making a yarn comprises a drawing frame 1 for drawing the roving 2, a device 3 which closely succeeds the drawing frame 1 and serves to twist the drawn roving 2, and a device 5 which is disposed between the twisting device 3 and withdrawing rollers 4 and serves to wind the fiber ends protruding from the roving around the latter. That device 5 for winding the protruding fiber ends around the twisted roving 2 comprises two suction drum 5*a*, 5*b*, which have vacuum inserts 6 that define suction zones 7 (FIG. 4), by which the roving 2 is pulled into the generally triangular space between the suction drums 5*a*, 5*b* so that the roving 2 will always be in snug contact with the peripheral surfaces of both drums regardless of the thickness of the roving. As a result, a guiding gap 8, which tapers transversely to the direction of travel of the roving 2 in the gap, is formed in the generally triangular space between the two suction drums 5*a* and 5*b* and the gap is bounded by sliding surfaces 9 which contact the roving 2. This arrangement will promote the winding of the fiber ends protruding from the roving around the latter if the roving 2 performs a sufficient rotation adjacent to the suction drums 5*a* and 5*b* because the fibers protruding from the roving will then be deflected transversely to the axis of the roving and forced against the roving 2 particularly by the sliding surface 9 of the suction drum 5*a*, where the roving rotates toward the narrowest portion of the triangular space. The other suction drum 5*b* promotes the twisting of the protruding fiber ends and strongly promotes the smoothening of the yarn.

To ensure that the protruding fiber ends will be wound around the roving in a sense which is opposite to the sense in which the roving is twisted, it is essential that the roving performs an adequate rotation adjacent to the sliding surfaces 9. For this reason the suction drums 5*a* and 5*b* must not exert a disturbingly strong braking torque on the roving 2 so that the sliding surfaces 9 of the suction drums 5*a* and 5*b* should be rather smooth to ensure that the frictional resistance will be low. This is also significant because the suction drums 5*a* and 5*b* are desirably rotated in the same sense as the roving 2 so that the sliding surfaces 9 will perform a sliding movement in a sense which is opposite to the peripheral movement of the surface of the roving. As the sliding surfaces then move in the sense in which the fiber ends are wound around the roving, they will assist said winding.

To ensure an adequate rotation of the roving adjacent to the suction drums 5*a* and 5*b*, an effective twisting of the roving 2 must be achieved. For this purpose the twisting device 3 consists of two suction drums 3*a* 3*b*, which rotate in the same sense, which is opposite to the sense of rotation of the suction drums 5*a* and 5*b*. As the roving 2 is pulled into the generally triangular space between the suction drums 3*a* and 3*b* by vacuum inserts 11, which are contained in the suction drums 3*a* and 3*b* and define suction zones 10 thereon, and the roving is forced against the surfaces of both suction drums at the same time, a high twisting torque can be exerted to the roving 2 by the suction drums 3*a* and 3*b*, particularly if the surfaces of the drums are rough in order to increase the friction.

To ensure that the rotation of the roving will be transmitted into the region between the suction drums 5*a* and 5*b*, the distance between the twisting device 3 and the winding device 5 should be small. In the present embodiment that distance is determined only by the belt drive 12 for the suction drums 3*a* and 3*b*. The vacuum inserts 6 and 11 of the suction drums 3*a* and 5*a* constitute a common insert 13, just as the suction inserts 6 and 11 of the suction drums 3*b* and 5*b*. On said inserts, the associated suction drums and the pulleys for the belt drive 12 for the suction drums 3*a* and 3*b* and the pulleys for the belt drive 14 for the suction drums 5*a* and 5*b* are rotatably mounted.

To ensure that the roving 2 between the delivery rollers 1*a* of the drawing frame 1 and the withdrawing rollers 4 will not be subjected to a tension which would resist the twisting of the roving 2 and the winding of the proturding fiber ends around the roving, the circumferential velocity of the withdrawing rollers 4 is lower than the circumferential velocity of the pair of delivery rollers 1*a*. As a result, the yarn is withdrawn at a velocity that is lower than the velocity at which the roving 2 is delivered by the drawing frame 1.

Because the fiber ends protruding from the roving are deflected by a sliding surface, the fiber ends can be moved to the sliding surface in a direction which is transverse to the axis of the roving. If the sliding surfaces 9 define a tapered guiding gap 8, a larger included angle of said guiding gap will be desirable for deflecting the fiber ends and a smaller included angle for forcing of the deflected fiber ends to the roving. For this reason the included angle of the guiding gap 8 may decrease in the direction of travel of the roving 2 through said gap. This requirement will be met by the provision of conical suction drums 5*a* and 5*b*, which can be made in a simple manner. FIG. 5 shows a device 5 which serves to wind protruding fiber ends around the roving 2 and comprises conical suction drums 5*a* and 5*b*.

What is claimed is:

1. In apparatus for making a yarn from a roving, comprising twisting and winding means for twisting a drawn roving so as to form a twisted roving having protruding fiber ends and for winding said protruding fiber ends around said twisted roving, and withdrawing rollers for withdrawing a yarn made from said roving, the improvement residing in that said twisting and winding means comprises a twisting device for twisting said drawn roving so as to form a twisted roving having protruding fiber ends and a winding device which is separate from said twisting device and operable to wind said protruding fiber ends around said twisted roving, said winding device comprises sliding surfaces defining and bounding a guiding gap, said withdrawing rollers are operable to pull said twisted roving through said guiding gap in a predetermined direction of travel and in contact with said sliding surfaces, and said guiding gap tapers transversely to said direction of travel.

2. The improvement set forth in claim 1, wherein at least one of said sliding surfaces has an air-permeable portion adjacent to the narrowest portion of said guiding gap, and comprising means for applying to said air-permeable portion a vacuum tending to pull said roving toward said air-permeable portion.

3. The improvement set forth in claim 1, wherein said sliding surfaces are smooth.

4. The improvement set forth in claim 1, wherein the angle included by said sliding surfaces decreases in said direction of travel.

5. The improvement set forth in claim 1, wherein said twisting device is operable to rotate said roving in a predetermined sense, comprising means for moving at least one of said sliding surfaces in a direction which is opposite to the direction in which said roving is moved adjacent to said one sliding surface as a result of the rotation imparted to said roving by said twisting device.

6. The improvement set forth in claim 1, wherein said twisting device is operable to rotate said roving in a first sense, said sliding surfaces are formed by two juxtaposed, closely spaced apart, revolvable members, and comprising means for revolving said revolvable members in a second sense opposite to said first sense.

7. The improvement set forth in claim 6, wherein each of said revolvable members consists of a suction drum.

8. The improvement set forth in claim 1, comprising a drawing frame which comprises a pair of delivery rollers for delivering said drawn roving to said twisting device and means for rotating said delivering rollers at a predetermined circumferential velocity, and means for rotating said withdrawing rollers at a circumferential velocity which is lower than said predetermined circumferential velocity.

9. The improvement set forth in claim 1, wherein the distance from said twisting device to said withdrawing rollers is substantially as large as the length of said guiding gap.

* * * * *